US005133132A

United States Patent [19]

Yu

[11] Patent Number: 5,133,132

[45] Date of Patent: Jul. 28, 1992

[54] SAFETY BLADE

[76] Inventor: Ying-Ming Yu, 5F1, No. 9∝, Alley 19, Lane 71, Lin-Yi Street, Taipei, Taiwan

[21] Appl. No.: 602,955

[22] Filed: Oct. 26, 1990

[51] Int. Cl.[5] ..... B26B 29/00; B26B 9/02

[52] U.S. Cl. ..... 30/286

[58] Field of Search ..... 30/353, 355, 356, 357, 30/279.2, 287, 314, 286

[56] References Cited

U.S. PATENT DOCUMENTS

| | | | |
|---|---|---|---|
| 2,685,734 | 8/1954 | Klein | 30/355 |
| 2,753,632 | 7/1956 | Varn | 30/355 |
| 2,798,292 | 7/1957 | Bishaf | 30/355 |
| 3,203,295 | 8/1965 | Sauer | 30/355 |
| 3,658,106 | 4/1972 | Elsasser . | |
| 3,745,869 | 7/1973 | Ludwig | 30/355 |
| 4,677,749 | 7/1987 | Brison | 30/355 |
| 4,912,846 | 4/1990 | Yu . | |

*Primary Examiner*—Douglas D. Watts
*Assistant Examiner*—Paul M. Heyrana
*Attorney, Agent, or Firm*—Fleit, Jacobson, Cohn, Price, Holman & Stern

[57] ABSTRACT

A safety blade has a cutting edge 41 formed with a plurality of protrusions or projections 42 extending in front of the blade in a comb structure which extends from one end of the cutting edge to the other. The projections prevent the edge from contacting skin, but do not prevent the cutting edge from performing its function. Such a blade may be used in kitchen utensils and cutlery, such as steak or fruit knives, or craft tools or the like.

4 Claims, 1 Drawing Sheet

SAFETY BLADE

The present invention relates to safety blades for use for example in knives, and other cutting tools.

A conventional cutting tool is in general provided with a blade having a straight or serrated cutting edge, depending on the intended purpose of the tool, whether for sawing, scraping, or cutting through. Careless use of cutting tools often leads to injury on the blade however, but attempts to improve safety, by shielding the blade for example, often compromise the effectiveness of the tool. One prior art cutting tool are shown in FIG.

U.S. Pat. No. 3,797,110, is shown, makes use of a machine to stamp a metal sheet with a plurality of grooves, so that the surface of the metal sheet forms a plurality of proturding ribs. The bottom edge of the metal sheet is then ground into an incline or bevel by a grinding tool so that the grooved edge forms a sharp cutting edge, and the ends of protruding ribs, due to the grinding angle, protrude beyond the sharp cutting edge. When shaving, the edges of each pair of protruding ribs are pressed against the user's skin, which lightly contacts the cutting edge. When the shaver is sliding, the user's hair can be safely shaved. However, under the limitations of the manufacturing process, the other reverse fact of the metal sheet cannot be similarly made with a plurality of protruding ribs, and thus cannot be used for shaving, so that the blade is not reversible. The grooves also tend to harbour dirt which cannot be easily cleaned and thus is unhygenic. Such a blade cannot be used like a conventional razor, which can be used reversibly, so as to enhance its convenience of use, and for cleaning the blade.

An object of this invention is to provide a safety blade which will not be able to bring its cutting edge into contact with a user's skin due to careless use or by accident.

According to the invention, there is provided a safety blade characterised in that it has a cutting edge provided with a plurality of smooth-faced and rounded projections of suitable size arranged as a comb extending from one end of the cutting edge to the other, the protuberances being integrally formed with the cutting edge.

The size and spacing of the protuberances will depend upon the intended use of the blade.

The cutting edge is divided into sections between the protuberances or projections, and the sections of cutting edge may each be straight or curved, for example arcuate.

A blade according to the invention may be adapted for use in carve, or for household or culinary use, in cutlery and craft tools also.

The invention will be further described by way of example, with reference to the accompanying drawings, wherein:

FIG. 1. already referred to, is a detail view of a blade made in accordance with U.S. Pat. No. 3,797,110;

Figure 1:
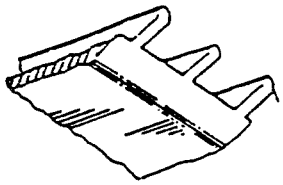
Figure 2:
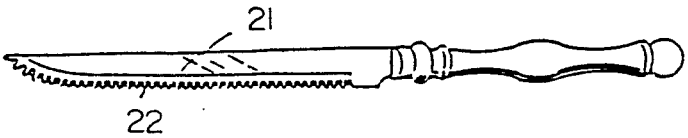
FIG. 2 is a view of a first embodiment of blade according the invention, embodied in a fruit knife with a straight cutting edge.
Figure 2A:
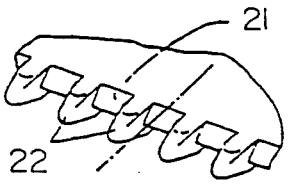
FIG. 2A is an enlarged view of part of the cutting edge and projections formed thereon.
Figure 2B:
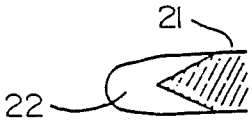
FIG. 2B is a further enlarged sectional view of the cutting edge and a projection in the FIG. 4 embodiment.
Figure 3:
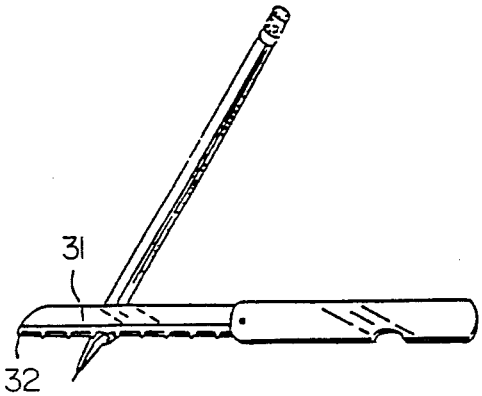
FIG. 3 is a perspective view of a second embodiment of the invention in a pencil sharpening knife with a straight cutting edge.

As shown in FIGS. 2 and 3, a straight cutting edge 21 or (31) respectively is provided with a plurality of smooth faced, rounded and suitably spaced projections or protuberances 22(32), of suitable dimensions arranged in the form of a comb to project in front of the cutting edge 21(31).

Figure 4A:
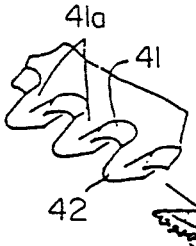
FIGS. 4A and 4B are perspective view of a third embodiment of the invention in a fruit knife with a corrugated cutting edge.
Figure 4B:
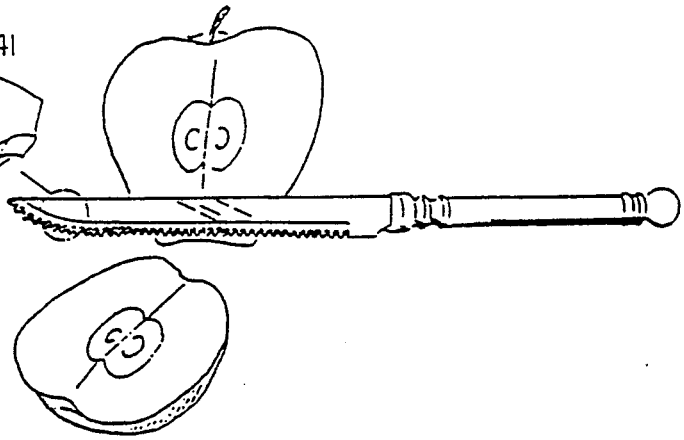
Figure 5:
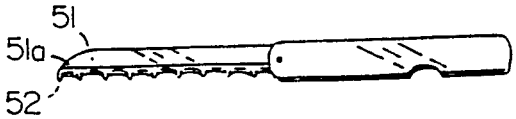
FIG. 5 is a perspective view of a fourth embodiment of the invention as a pencil shapening knife with a corrugated or fluted cutting edge.

As shown in FIGS. 4A, 4B and 5, a corrugated or fluted cutting edge 41(51) is provided with a plurality of smooth faced, rounded and equally spaced projections or protuberance 42(52) of suitable dimensions and similar to those in FIGS. 2 and 3, and arranged as a comb projecting in front of the extremity 41*a* (51*a*) of the cutting edge 41(51).

In FIGS. 2 and 3, the sections of cutting edge between the projections are straight, whilst in FIGS. 4A, 4B and 5 the sections of cutting edge between the projections are curved or arcuate.

When using these safe blades, if these projections first contact the user's skin which is pressed by the projections and can only slightly enter between the projections to contact the cutting edge, no matter how much pressure is exerted on the blade, so that the cutting edge just contacts the skin for cut somethings, but can never penetrate user's skin, thus ensuring safety in the carve operation.

In these examples, the smooth-faced and rounded projections or protuberances on the cutting edge are similar in general form to a plurality of conical members, the bases of which merge with the cutting edge but do not project ahead of the cutting edge. Those embodiments therefore provide safety blades which, like a conventional knife, is fully reversible, as both faces can be used for carve.

I claim:

1. A safety blade comprising:

a blade body having two planar surfaces and a cutting edge located at one end of said two planar surfaces, said cutting edge including a plurality of smooth-faced and rounded projections arranged as a comb and extending from one planar surface to the other planar surface at said one end of said cutting edge, said projections being integrally formed with said cutting edge, and a cutting blade tapering inwardly from said one planar surface towards a center of an adjacent smooth-faced and rounded projection and tapering inwardly from said other planar surface towards a center of an adjacent smooth-faced and rounded projection to form said cutting edge located centrally of said smooth-faced and rounded projections, said cutting blade being located between adjacent projections and being recessed from said projections to prevent cutting of the skin of a user during accidental contact of said cutting edge with the skin of a user.

2. A blade according to claim 1 wherein the cutting edge is divided into sections between the projections, and the sections are straight.

3. A blade according to claim 1 wherein the cutting edge is divided into sections between the projections and the sections are curved or arcuate.

4. A knife, or other cutting tool including a blade according to claim 1.

* * * * *